US006159112A

United States Patent [19]

Ciluffo et al.

[11] Patent Number: 6,159,112

[45] Date of Patent: Dec. 12, 2000

[54] AUTOMATIC THROWING APPARATUS

[75] Inventors: C. Gary Ciluffo, Vincennes; Arthur E. Hirsch, Terre Haute, both of Ind.

[73] Assignee: Creative Technology Applications, Inc., Vincennes, Ind.

[21] Appl. No.: 09/191,241

[22] Filed: Nov. 13, 1998

[51] Int. Cl.[7] ..... A63B 69/00; F41B 3/04; F41F 7/00

[52] U.S. Cl. ..... 473/451; 124/4; 124/6; 473/415

[58] Field of Search ..... 124/4, 6, 42, 47, 124/50; 473/451

[56] References Cited

U.S. PATENT DOCUMENTS

| | | | |
|---|---|---|---|
| 715,179 | 12/1902 | Troutner . | |
| 1,408,137 | 2/1922 | Parsons . | |
| 1,662,629 | 3/1928 | Baden-Powell . | |
| 3,552,900 | 1/1971 | Newill . | |
| 3,585,978 | 6/1971 | Hurlimann . | |
| 3,613,655 | 10/1971 | Tobin et al. . | |
| 3,822,688 | 7/1974 | Mayne . | |
| 4,632,086 | 12/1986 | Rutten . | |
| 4,747,390 | 5/1988 | Storm . | |
| 4,915,384 | 4/1990 | Bear | 473/451 |
| 5,195,744 | 3/1993 | Kapp et al. | 473/451 |
| 5,464,208 | 11/1995 | Pierce | 473/451 |
| 5,479,008 | 12/1995 | Nishiyama et al. | 473/451 |
| 5,590,876 | 1/1997 | Sejnowski | 473/451 |
| 5,639,084 | 6/1997 | Kawasaki | 473/451 |
| 5,749,797 | 5/1998 | Sunseri et al. | 473/451 |
| 5,857,451 | 1/1999 | Ciluffo et al. . | |

FOREIGN PATENT DOCUMENTS

| | | |
|---|---|---|
| 87961 | 11/1896 | Germany . |
| 437359 | 7/1934 | United Kingdom . |
| 526908 | 9/1940 | United Kingdom . |

*Primary Examiner*—Jeanette Chapman
*Assistant Examiner*—Mitra Aryanpour
*Attorney, Agent, or Firm*—Polster, Lieder, Woodruff & Lucchesi, LC

[57] ABSTRACT

An automatic throwing machine (10) includes a throwing arm (18) rotated by a worm gear (78) driven by a worm (76) carried on a rod (42). The rod is driven by an electric motor (32). An extension spring (68) is extensible as the arm is moved to store energy in the spring and create a torque on the throwing arm. The arm is configured for objects such as clay pigeons (P), baseballs (B), and hockey pucks (H) and the like. When the spring reaches an over-center position, the throwing arm is rapidly rotated to launch the object along a desired trajectory. A control (112) controls operation of the motor. A passive infrared detector (110) identifies people (X) near the device and controls the direction of discharge of the object so the object is thrown toward, or away from, the person depending upon the object being thrown. The detector further provides an interlock to prevent object release if there is a person in the direction the object is thrown who should not be there. A capacitance sensor (C) insures that the object to be thrown is the correct object to be launched.

18 Claims, 7 Drawing Sheets

AUTOMATIC THROWING APPARATUS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to an automatic throwing apparatus or machine for throwing clay pigeons, baseballs, softballs, tennis balls, balls for street hockey play, hockey pucks (for both ice and street hockey), volley balls, basketballs, footballs, and other objects where a controlled repetition of the throwing action is desired.

There are numerous patents relating to throwing objects by a mechanical means. For example, U.S. Pat. No. 715,179, describes a target trap machine including an ejector 62 driven by a shaft 61. The shaft is connected through a bevel-pinion 67 to a bevel gear-wheel 69 on a shaft 46. This latter shaft is driven by a human operator through pedals 43, sprockets 39 and a drive chain 44. A coil spring 147 is wound up as the operator drives the drive chain, and the ejector is rotated to the back of the trap machine. When the operator pulls on a cord 93, the ejector is released and pivots around ejecting the clay pigeon. The machine described requires a manual operator, and has limited throwing capacity because of the limited mechanical advantage achieved by the particular component arrangement.

U.S. Pat. No. 3,552,900 is directed to a centrifugal trapshooting device having a pair of rotating launching arms. One arm is manually adjustable. The other arm is tripped by a trigger on the first arm. The arms are supported by a rotary drive shaft at their respective inner ends. This shaft is driven by a high torque, low resistance, battery powered D.C. motor.

U.S. Pat. No. 3,585,978 discloses a centrifugally operated device for throwing baseballs, softballs, and tennis balls. The device includes a barrel having an outlet at one end and inlet intermediate its ends. The barrel rotates about a horizontal axis. Means are provided for controlling the angle and speed of discharge of the tennis ball, baseball or softball. Although mention is made of throwing clay pigeons of the device, an adaptation of the device for that purpose is not shown.

U.S. Pat. No. 3,822,688 describes a centrifugal machine for shooting hockey pucks. The device includes an automatic loader and can be controlled to vary the interval, speed, and direction of the pucks.

U.S. Pat. No. 4,747,390 is directed to a target projector for clay pigeons which also operates by centrifugal force. A throwing arm of the projector is driven by an electric motor, and an electric switch controls release of the individual clay pigeons. These are fed to the throwing arm from a magazine disposed above an inner end of the throwing arm. Unlike many similar devices, this patent does not use spring action to impart a force to the clay pigeons.

While the prior art teaches a variety of devices to launch objects of various types such as balls and clay pigeons, there are still a number of significant issues, including safety issues, which need to be resolved. In addition, the various prior art devices are static devices in that generally they allow only a limited range of use once they are set up in a particular configuration. A device able to provide a greater range of usage has significant advantages for use in practicing or playing a sport.

BRIEF SUMMARY OF THE INVENTION

Among the objects of the present invention may be noted the provision of an automatic throwing apparatus capable of throwing a number of different objects;

the provision of such apparatus easily adapted to throw clay pigeons, baseballs, hockey pucks, footballs as well as other objects;

the provision of such apparatus which is compact, readily portable, and durable in the outdoor environments in which it is used;

the provision of such apparatus which can be remotely operated by voice commands or the like, and will launch objects such as pucks, balls, and clay pigeons at different angles and directions with respect to a person interacting with the launched object;

the provision of such apparatus whose operation is automated;

the provision of such apparatus to include a position sensor such as an infrared sensor for locating the person interacting with an object to be launched prior to launching the object;

the provision of such apparatus to employ a locating device worn by the person interacting with the apparatus for locating and tracking the person;

the provision of such apparatus to utilize a characteristic of the object to be thrown, or an indicia formed or placed on the object to determine if the object is one which the apparatus may throw; the provision of such apparatus having safety features such as an infrared sensor which disables the device when it detects a person in the expected path of the object being thrown who should not be there, and an interlock which determines if a puck, ball, or other object to be thrown by the apparatus is the correct object to throw; and, the provision of such apparatus which is relatively inexpensive to manufacture.

In accordance with the invention, generally stated, the apparatus includes a throwing arm mounted at one end to a rotatable post. One end of a spring is secured to the post. A reversible drive electric motor operates a drive belt/pulley system which rotates a worm. The worm, in turn, drives a worm gear. The worm gear is commonly mounted on a hub with an arm to which the other end of the post is attached. A rod mounted on the worm gear bears against this latter arm to rotate the arm and post as the worm gear turns. A hockey puck or clay pigeon rests on the throwing arm. Continued rotation of the worm gear causes the spring to be pulled to an over-centerposition at which time the spring snaps back to an initial, untensioned position. This movement causes the loaded throwing arm to rapidly rotate and throw the object along a desired trajectory. A first infrared detector for identifying and/or tracking of people near the device control the direction of discharge of the object so the object is thrown toward, or away from, the person depending upon the object being thrown. A second infrared detector detects the presence of a person in the direction the object is thrown who should not be there; and, if such a person is present, the device is disabled so no object is thrown. The object thrown can be made so when it rests on the throwing arm prior to launch a sensor can determine if the object is the proper object to launch. Other objects and features will be in part apparent and in part pointed out hereinafter.

BRIEF DESCRIPTION OF THE SEVERAL VIEWS OF THE DRAWINGS

In the drawings.

FIG. 6 is an elevational side view of an embodiment of the automatic throwing machine for throwing balls such as baseballs, softballs, tennis balls, and the like;

Corresponding reference characters indicate corresponding parts throughout the drawings.

DETAILED DESCRIPTION OF THE INVENTION

Figure 1:
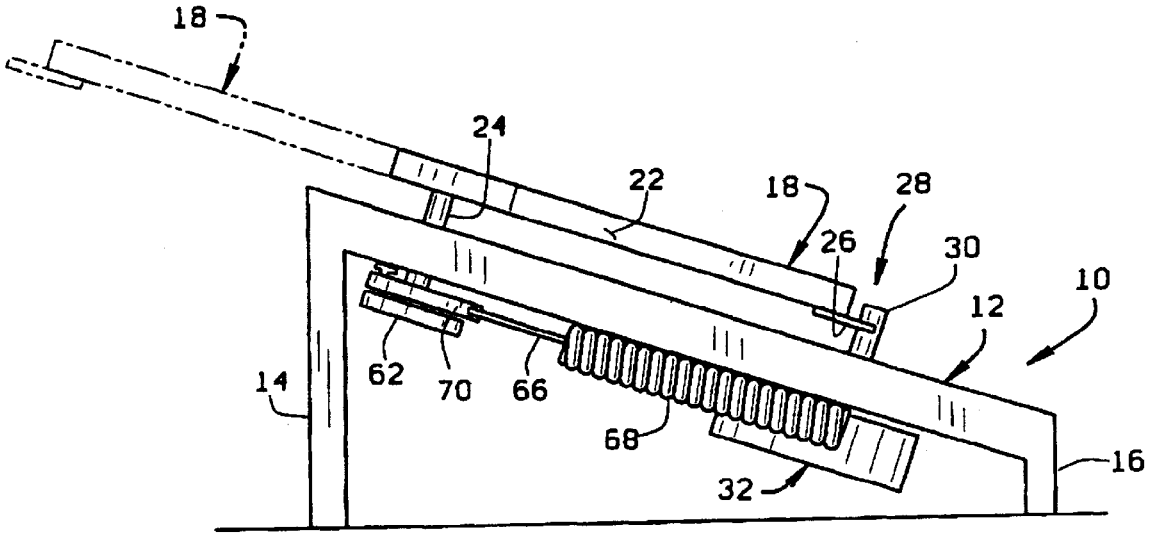
FIG. 1 is an elevational view of an automatic throwing apparatus of the present invention for throwing an object such as a clay pigeon.
Figure 2:
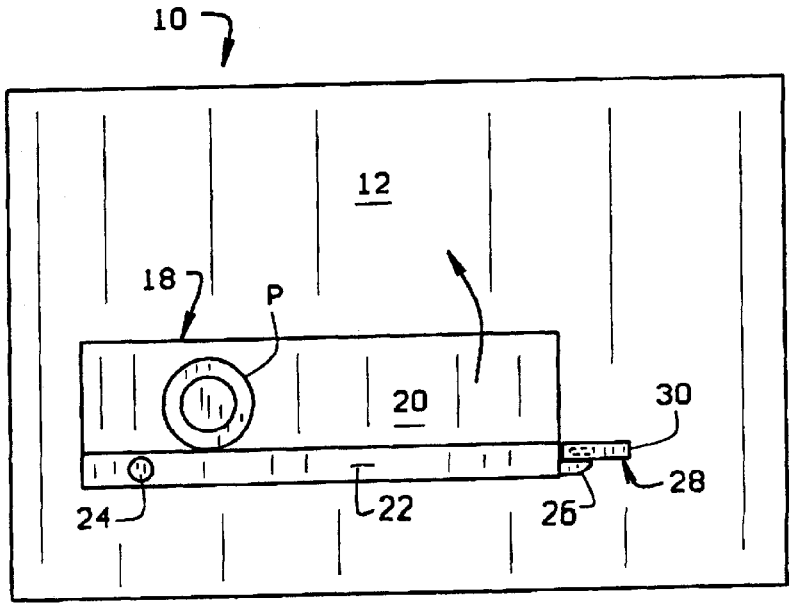
FIG. 2 is a top plan view of the apparatus.

Referring to the drawings, an automatic throwing apparatus or machine of the present invention is indicated generally 10 in FIG. 1. It is a feature of the invention that apparatus 10 is capable of throwing a variety of objects (generally classified as spherical and disc shaped objects). In the embodiment of FIG. 1, the apparatus includes a platform 12 having respective pairs of legs 14, 16 at opposite ends of the platform. Only one leg of each pair is shown in the drawings. The legs comprising pair 14 are longer than those comprising pair 16 so platform 12 rests at an angle to the ground when the device is set-up. The embodiment of the apparatus shown in FIGS. 1 and 2 is for launching disc shaped objects such as clay pigeons P. Thus, a launch arm 18 is mounted above platform 12 and moves on an axis parallel to the horizontal axis of the platform. Arm 18 includes a rectangularly shaped, flat plate 20 on which a clay pigeon P rests. The clay pigeon is loaded onto the arm from a magazine feed or carousel feed (not shown). An upturned flange 22 extends along one entire side of the plate, the flange guiding movement of the clay pigeon on the plate. A pivotable post 24 extends upwardly from platform 12 near the elevated end of the platform, and arm 18 is rotatably secured to the outer end of this post. A trip arm 26 extends from the underside of arm 18, at the opposite end of the throwing arm, the trip arm extending longitudinally of the throwing arm. When throwing arm 18 is in its cocked position shown in FIG. 2, trip arm 26 is engaged by a release mechanism 28. In particular, the trip arm is engaged by a cocking member 30 of the release mechanism. Throwing arm 18 is held in its cocked position so long as the trip arm is engaged by the cocking member. However, when the cocking member is moved away from contact with the trip arm, as described hereinafter, the throwing arm moves in the counter-clockwise direction indicated by the arrow in FIG. 2. As the throwing arm reaches its release position (its dashed line position in FIG. 1), the clay pigeon is flung off the arm by centrifugal force and flies along a desired trajectory away from the device.

Figure 3:
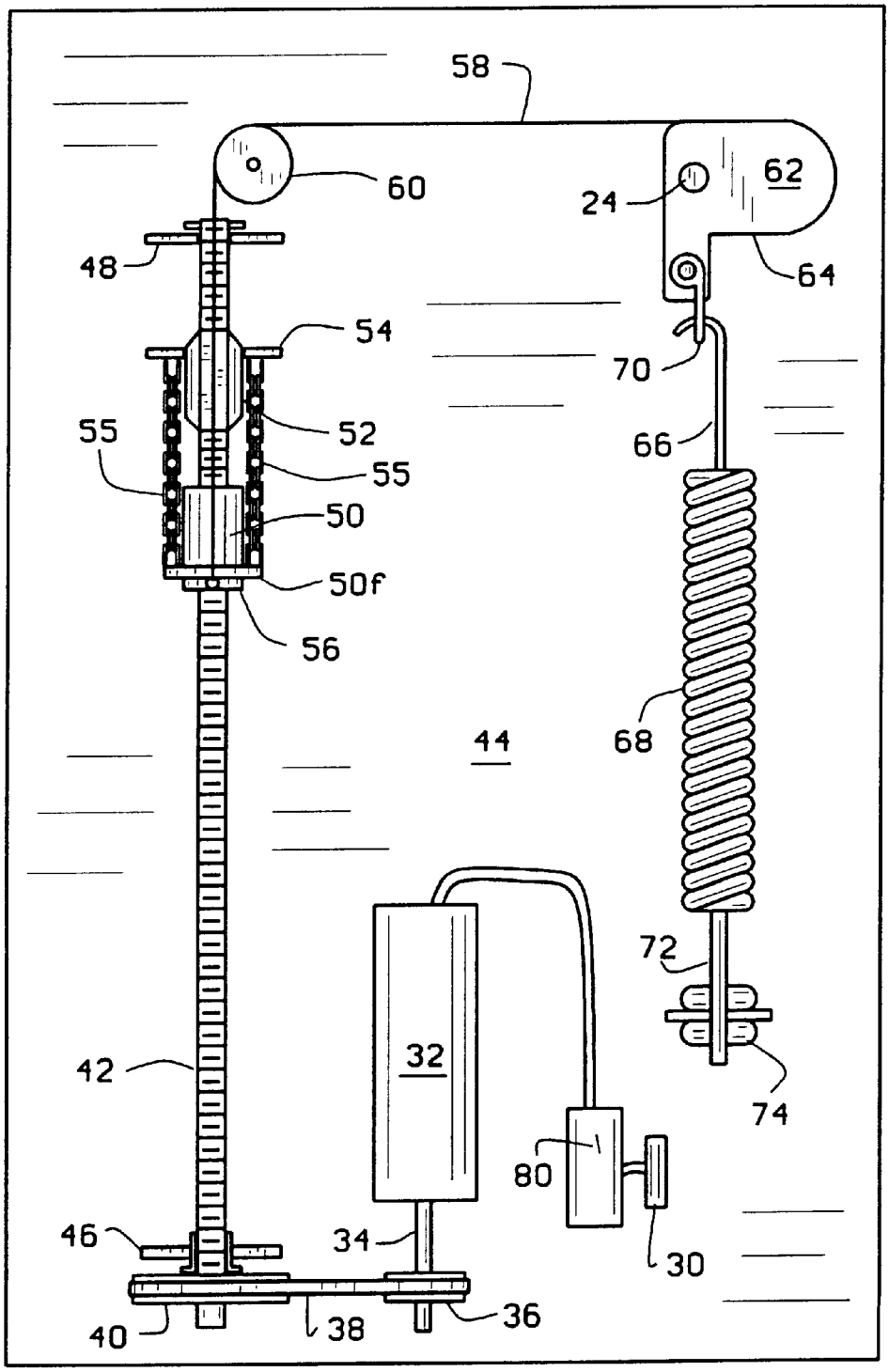
FIG. 3 is a schematic representation of a first motive means for moving a throwing arm of the machine.

In more detail now, and as shown in FIG. 3, a motive means for the throwing arm includes a motor 32 having a motor shaft 34 on the outer end of which a drive pulley 36 is mounted. A drive belt 38 of rugged design, such as an automotive timing belt, is fitted onto pulley 36. The other end of belt 38 is carried on a driven pulley 40. Pulley 40 is mounted onto one end of a threaded drive shaft 42. The drive shaft is rotatably mounted to a housing 44, in which the various described components are installed, by a first (lower) bearing assembly 46 and a second (upper) bearing assembly 48.

An internally threaded, annular drive cuff 50 is threadably received on drive shaft 42, and moves up or down, depending on the direction of rotation of the drive shaft by motor 32. A stop 52 is slidably mounted on drive shaft 42 between drive cuff 50 and upper bearing assembly 48. The stop is used to cushion the cuff as the cuff is driven toward the top of drive shaft 42. For this purpose, the stop is fitted about the drive shaft at the location corresponding to the limit of travel of the cuff on the shaft. An arm 54 is welded or otherwise permanently secured to cuff 50. A chain 55 interconnects stop 52 and cuff 50.

A cuff ring 56 is mounted on drive shaft 42 just beneath a flange 50*f* of cuff ring 50 as shown in FIG. 3 A pair of cables 58 (only one of which is shown in FIG. 3) each have one of their ends attached to cuff ring 56. The respective ends of the cables are attached to the cuff ring on opposite sides of the cuff ring. Both cables extend through a pulley 60 and the other end of each of the cables are connected to an eccentric cam 62 as indicated at 64. Cam 62 is mounted on the inner end of rotatable post 24. Movement of cuff 50 up and down on drive shaft 42 produces a corresponding movement of the cuff ring. This, in turn, causes rotary movement of post 24 and of cam 62. Cam 62 is an L-shaped cam and one end 66 of an extension spring 68 is secured to a bracket 70 affixed to the lower end of the cam. The other end 72 of the extension spring is anchored to housing 44 by an adjustable housing bracket 74.

Throwing arm 18, since it is attached to the outer end of post 24, rotates when cam 62 is rotated. To increase tension on spring 68, motor 32 is driven in a direction to rotate the drive shaft 42 so cuff 50 moves down the shaft away from cam 62. This tightens cables 58 and causes cam 62 (and post 24) to rotate counterclockwise, as shown in FIG. 3. In turn, this rotation causes the cam to draw end 66 of the spring upwardly, effectively lengthening the spring 68 and placing the spring under considerable tension. The rotation of post 24 with cam 62 moving throwing arm 18 to its cocked (solid line) position shown in FIGS. 1 and 2 at which time trip arm 26 is engaged by cocking member 30 of release mechanism 30.

After the trip arm is engaged by the cocking member, DC drive motor 32 is run in the reverse direction to that in which it was previously run, This moves cuff 52 in the opposite direction along shaft 42, and will allow cables 58 to return cam 62 back to its initial position. However, because the trip arm of throwing arm 18 is engaged by cocking member 30, cam 62 cannot move in the reverse direction. This means that spring 68 remains under tension. After a brief interval, motor 32 is turned off. At this time, a control unit 80 operates the release mechanism to move cocking member 30 away from trip arm 26. The control unit controls both operation of the motor 32 and the release member which is, for example, the plunger portion of a solenoid. A spring (not shown) urges the plunger into a position engaging trip arm 26 of the throwing arm. When motor 32 is shut off, control unit 80 activates the solenoid, moving the plunger out of contact with the trip arm. Now, cam 62 and spring 68 are free to return to their initial positions. The stored energy in the spring is transferred to the throwing arm, through cam 62 and post 24, so the throwing arm rotates rapidly in the counter-clockwise direction, releasing the object on the arm as it does so. Once a throw is completed, release mechanism 28 is reset, and the above described procedure is repeated once a new object is placed on the throwing arm.

Figure 4:
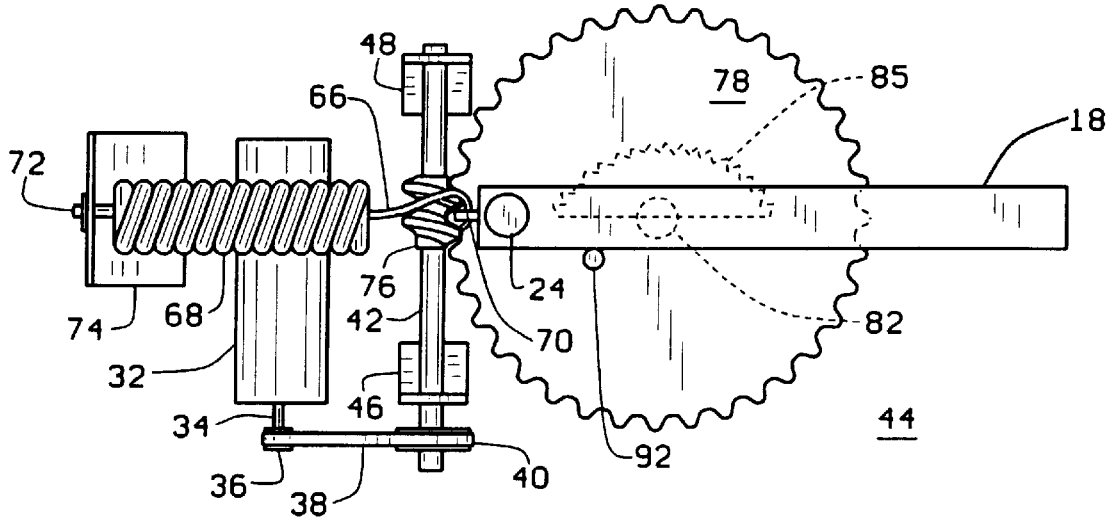
FIGS. 4 and 5 are respective a plan and elevational views of a second motive means for moving the throwing arm.
Figure 5:
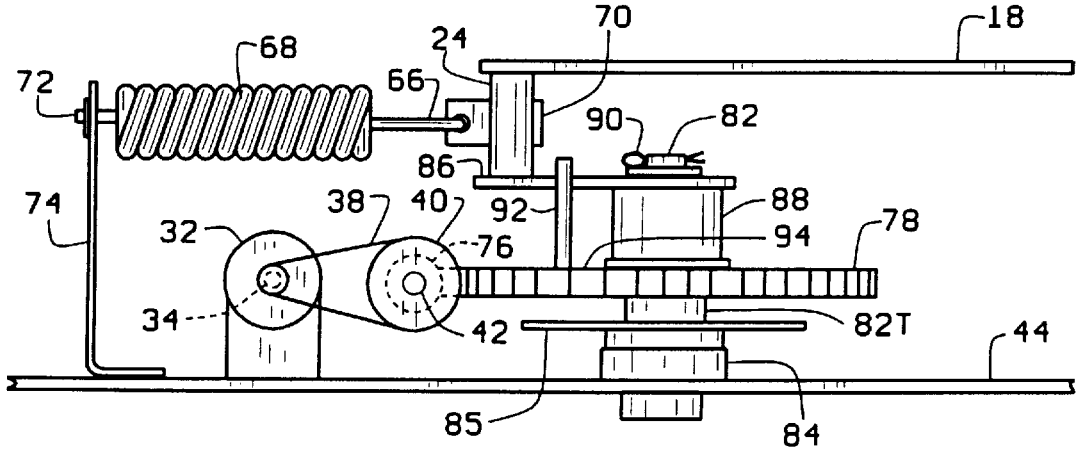

Referring to FIGS. 4 and 5, a second embodiment of the motive means of the present invention is described. As before, motor shaft 34 of variable speed DC motor 32 has a drive pulley 36 mounted on its outer end. Drive belt 38 is fitted onto this pulley. The other end of belt 38 is carried on driven pulley 40 which is mounted onto one end of drive shaft 42. The drive shaft is rotatably mounted to housing 44 by respective bearing assemblies 46, 48. A threaded worm 76 is installed on shaft 42 and rotates in the appropriate direction in accordance with the direction of motor rotation. Worm 76 meshes with a worm gear 78 to turn the worm gear clockwise or counter-clockwise, as appropriate. The worm gear has a central hub 82 extending through housing 44 to rotatably support the worm g ear, the hub being journaled in a bushing 84. Fitted above the bushing is a pawl 85 which extends halfway around hub 82 as shown in FIG. 4. A collar portion of the hub 82 is toothed as indicated at 82T. An arm 86 is secured to the upper end of hub 82. A spacer 88 comprises a collar which fits on hub 82 and separates the worm gear from arm 86. A cotter pin or similar form of attachment fits on the upper end of the hub, above arm 86, to hold the assembly together. Arm 86 rotates independently of the worm gear. A rod 92 has one end fixedly mount ed in the upper surface 94 of the worm gear and the rod projects vertically above the gear. As shown in FIG. 5, the upper end of rod 92 extends above the height of arm 86. When the worm gear is rotated by the worm, post 92 is brought into contact with a side of arm 86, bearing against the arm, and turning the arm in the same direction as the worm gear is rotating.

The bracket 70 previously secured to cam 62 is now attached to post 24. Accordingly, bracket 70 moves when post 24 rotates. As before, one end 66 of spring 68 is connected to bracket 70 and the other end 72 of the spring is secured to housing 44 by bracket 74. As with the earlier described embodiment, spring 68 is extended due to rotation of post 24 as throwing arm 18 is moved by the rotation of post 24 storing energy in the spring.

In operation, motor 32 drives in only one direction for worm 76 to continuously drive worm gear 78 in one direction. As the worm gear continues to rotate, rod 92 pushes against arm 86 moving the arm in the same direction. This, in turn, moves post 24 and throwing arm 18; and, at the same time, stretching spring 68. The pawl and ratchet mechanism comprised by the toothed portion 82T of hub 82 and pawl 85 allows arm 86 to only be driven in one direction. When arm 18 has been rotated 180° from its position shown in FIGS. 4 and 5, spring 68 is extended over-center, causing the spring to snap back to its unextended, rest position. This action causes throwing arm 18 to be rapidly rotated back to its initial position shown in the drawings, launching the clay pigeon or puck set upon the throwing arm as it does so. Motor 32 continues driving the worm gear in the same direction with post 92 again picking up arm 86 when the worm gear again reaches its position shown in FIGS. 4 and 5.

Figure 6:
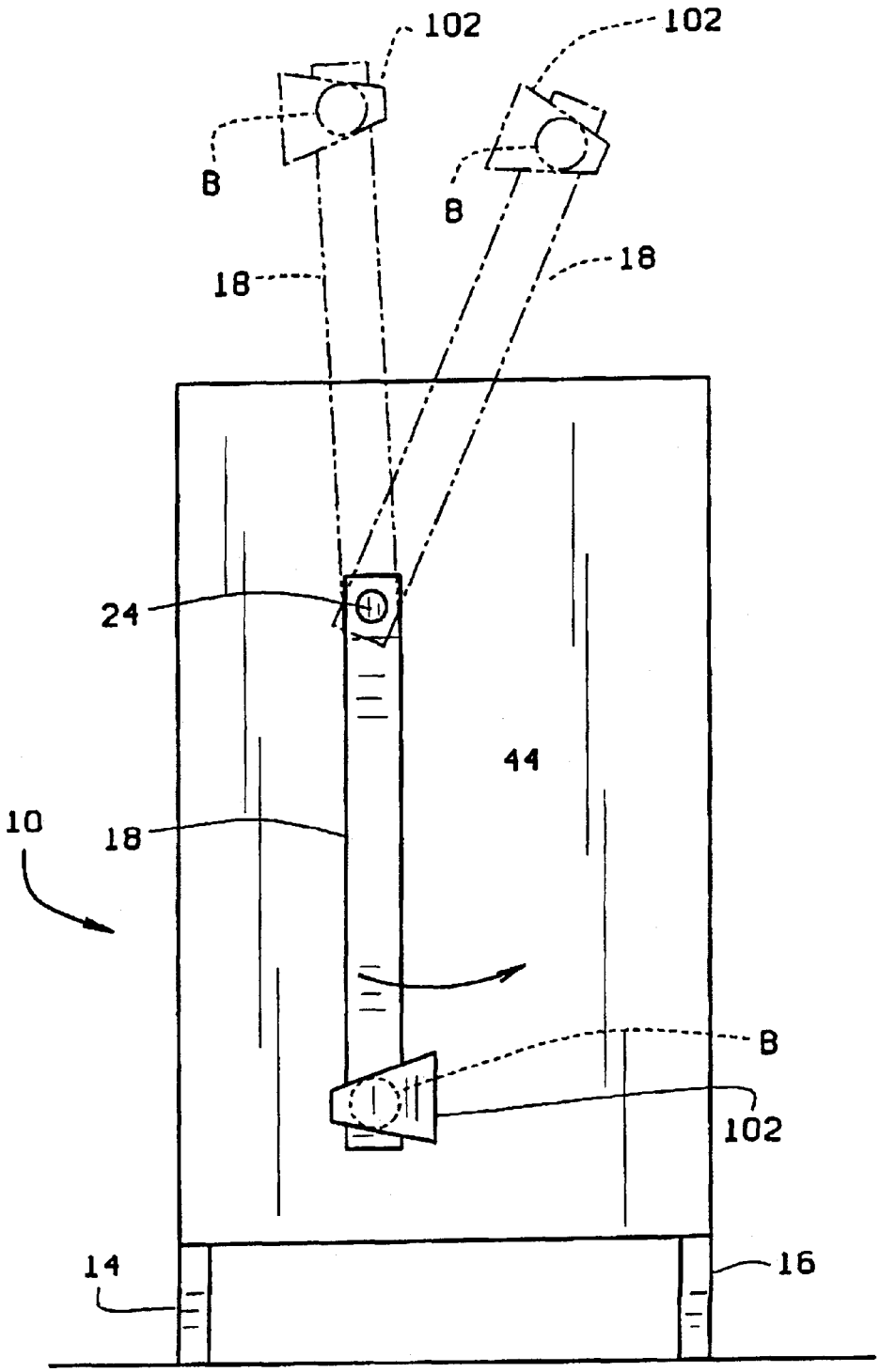

While the foregoing description is for an embodiment of the automatic throwing machine for launching clay pigeons, the device of the present invention is much more versatile. For example, as shown in FIG. 6, the machine can be configured in an upright mode for throwing baseballs, softballs, or tennis balls B, etc. Now, housing 44 is supported by pairs 14 and 16 of legs, the pairs of legs now being of equal length. A ball holder 102 is affixed to the outer end of throwing arm 18. In FIG. 6, the solid line position of arm 18 is its cocked position. The dashed lines positions represent release positions. Again, a magazine feed or carousel feed is used to provide a ball for throwing.

Figure 7:
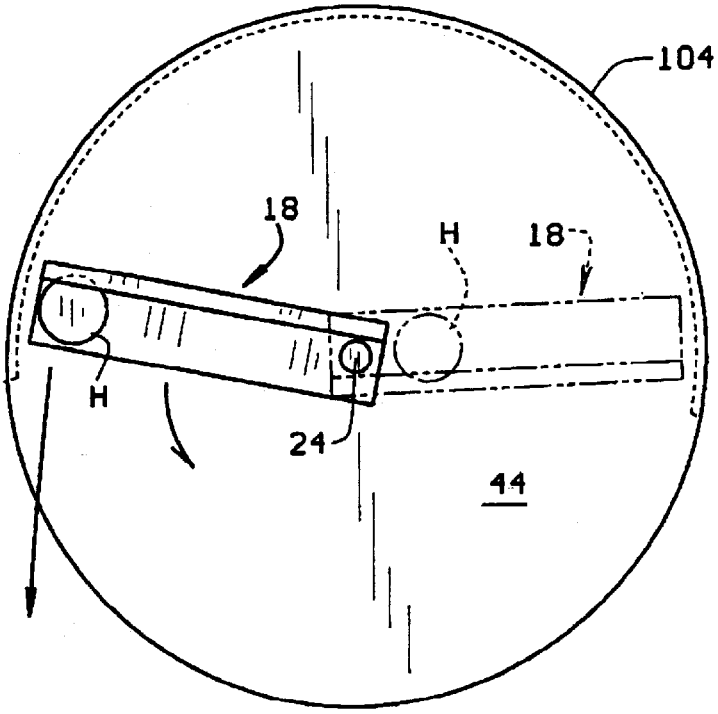
FIGS. 7 and 8 are views similar to FIGS. 1 and 2 for an automatic throwing machine for throwing pucks such as ice and street hockey pucks.
Figure 8:
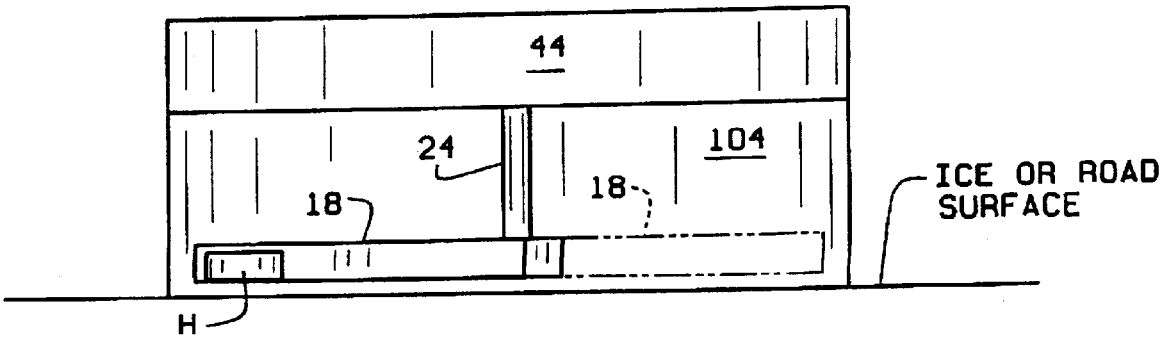

In FIGS. 7 and 8, an embodiment of the device for shooting hockey pucks H is shown. Now, housing 44 fits upon a shroud 104 which is open for a portion of its circumference. Post 24 extends downwardly from the housing toward the street or ice with throwing arm 18 being mounted at the lower end of the puck so to be just above the road or ice surface. Here, the solid line position of the throwing arm is its release position, while the dashed line position is an initial position of the arm where the puck is first placed upon it. For better control of the puck, arm 18 is C-shaped in cross section. Regardless of which of the three embodiments is being implemented, operation of the motive means is the same to cock and release the throwing arm. An appropriate feed mechanism is again used to load a puck onto the arm.

Figure 9A:
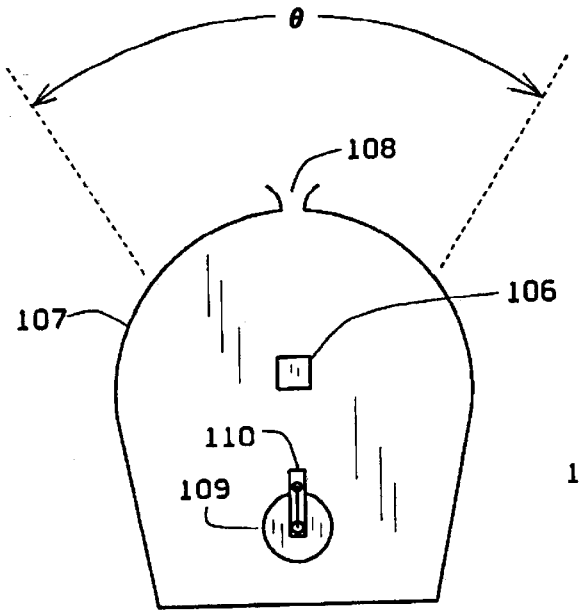
FIG. 9A is a plan view of the a passive infrared locator for identifying the location of a person interacting with a launched object.
Figure 9B:
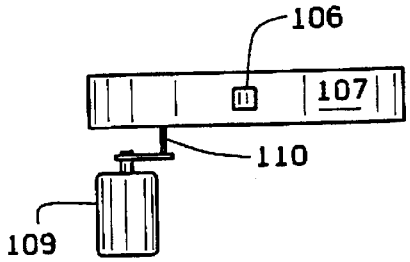
FIG. 9B illustrates a tracking mechanism for the locator.
Figure 10:
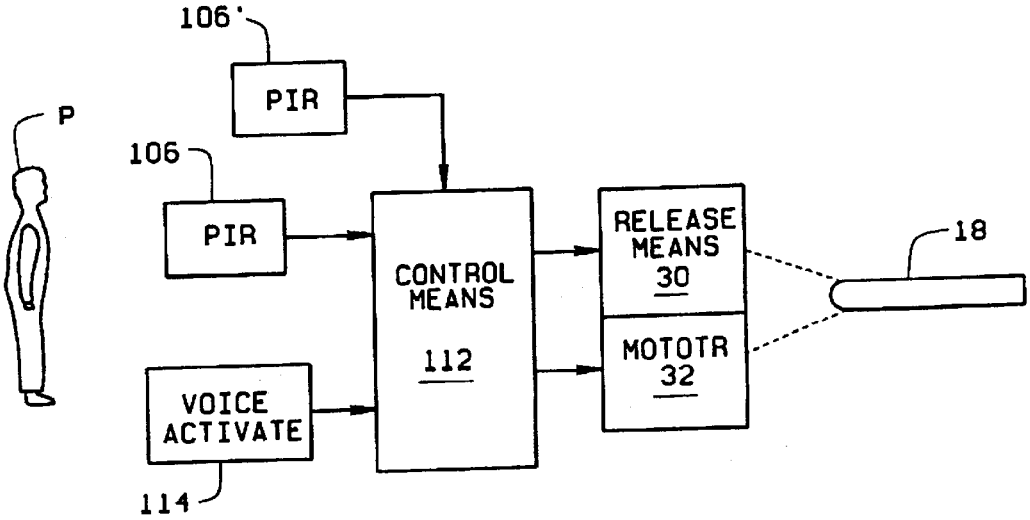
FIG. 10 is a block diagram of the apparatus.

Referring to FIGS. 9A and 9B, it is a feature of the present invention to monitor the location of a person who interacts with the object thrown from machine 10, as well as the location of others. As shown in FIGS. 9A and 9B, a passive infrared (PIR) locator 106 is in a housing (mask) 107 in which is formed a narrow aperture 108. A motor 109 has an attached reciprocating mechanism 110 for moving the housing through a monitoring angle θ which encompasses the area through which the object is directed. The mask which is, for example, of an opaque plastic material obstructs most of the view of PIR 106 except for the narrow opening or slit defined by aperture 108. As the locator assembly is rotated back and forth through angle θ, the PIR acquires and then loses the person or object (goal, for example) toward, or away from which, the clay, puck, or ball is to be thrown. This acquisition and loss is processed by circuitry within the control means; and, when combined with the rotational information as to the location of the sensor, provides location information about the person. A control means 112 controls both operation of motor 32, and release means 30. The control means comprises, for example, a microprocessor chip and auxiliary circuitry programmed to operate machine 10 in any desired operating mode. Locator 106, which can also be implemented using a laser (which has a greater range than the PIR), RF, ultrasound, or other means of detection, is used in several ways. First, since a person is supposed to interact with the thrown object, to hit or catch a ball, shoot a clay pigeon, block or stop a hockey puck, locator 106 checks to determine if a person is actually there. If not, it provides an input to control means 112 for the control means to not cause release of an object. If a person is in the vicinity, locator 106 monitors to see if the person is in an appropriate location. For example, a goalie at whom a hockey puck is shot should generally be located in the direction in which the puck is released. Or, for trap shooting, the person should be generally in the opposite direction to which the puck is released. If the locator senses the presence of a person within limits programmed into the control means (i.e., the angle θ), then the control means will effect release of the object. If not, then the control insures that an object is not released. It will be understood that other methods of location and tracking can also be used. For example, the person could wear a RF or similar device on his clothing and the sensor on the apparatus could sense a signal from the device to locate the person and track their movements.

Next, a separate locator 106, which may also be a PIR, determines if there is anyone in an area where they should not be and whose presence there places them in danger. For example, a person located in the direction where a clay pigeon is thrown is in danger not only from the clay pigeon, but also from being shot by the person using the machine. For baseballs, which can be thrown at velocities in the 80–90 mph range, a person whose presence is located to be 10 ft. in front of the machine, for example, risks serious injury if a ball is thrown. Accordingly, in these situations, control means 112 imposes a safety lockout on the machine so no object is released.

In addition to locator 106, machine 10 may also be remotely activated as by a voice activator 114. Activator 114 allows the user to control when an object is released. Otherwise, release of an object by the machine is in accordance with a timing protocol executed by control means 112. That is, the control means is programmed to release an object at a set interval after the machine is activated; for example, by placing an object on the throwing arm. If the user is not ready when the object is released, that's too bad. Use of voice activator 114 allows the user to be ready to react to the object before it is thrown.

Figure 11:
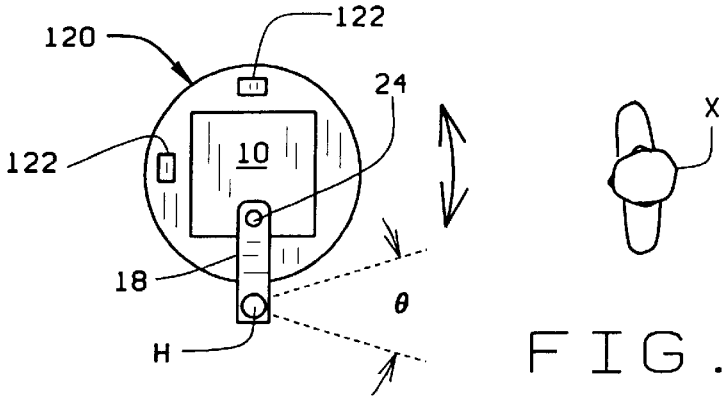
FIG. 11 is a simplified representation of the apparatus installed on a movable platform.

Next, it is a feature of the invention for machine 10 to be installed on a movable platform 120 so that the direction in which the object is thrown can be within an arc indicated by the angle ϕ in FIG. 11. Platform 120 may be a plate whose angular position is controlled by servomotors 122 under the control of control means 112. The servomotors allow the machine to be moved throughout the angle ϕ. Now, when locator 106 verifies the presence of a user X, the control means execute an algorithm to determine if the object is to be thrown directly at the person, or to one side of him or her; and if so, by how much. This provides a variability for the user which is comparable to what he or she will experience in actual play of game. It will be understood that for the clay throwing embodiment of the machine, where the clay P is thrown away from the user, this feature will allow the angle away from the user to be varied. It will be further understood that in addition to side-to-side (yaw) movement, the plate can also be moved up-and-down (pitch) using additional servomotors 122' under the control of means 112.

Figure 12A:
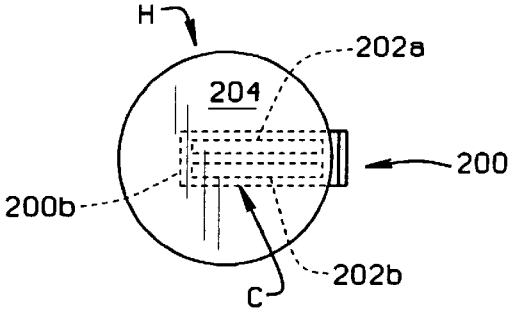
FIGS. 12A and 12B are respective top plan and side elevational views of a holder for the object, the hold incorporating for sensing if the object is the correct one to launch; and, FIG. 13 is a schematic of a circuit responsive to the sensor output for controlling launching of an object.
Figure 12B:
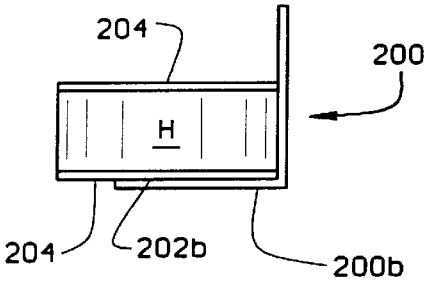

It is often desirable, for safety considerations, to insure that the disc shaped or spherical object thrown by the apparatus is acceptable for play. For example, if the apparatus is used for throwing a puck, it may not be desirable to allow a hard rubber ice hockey puck to be thrown by the machine at children using the machine for street hockey practice. Even at low velocities, a hard rubber puck may injure someone not wearing appropriate padding. As shown in FIGS. 12A and 12B, a puck holder 200 for holding a hockey puck is a L-shaped holder. Two electrically conductive strips 202*a*, 202*b* are set in a parallel, spaced arrangement on the base 200*b* of the puck holder. The strips comprise plates of a capacitor C. The hockey puck has metal or metalized plastic plates 204 on opposite sides thereof. When a puck is loaded onto the puck holder, the dielectric value of the capacitor changes. If the capacitor, for example, forms one branch of a capacitor bridge circuit, the output of the bridge circuit will change from one value when the puck rests on the holder, to another value when there is no puck in place. The bridge circuit comprises part of control means 112 which allows a puck to be thrown only when the appropriate puck is set upon the holder. Otherwise, the apparatus will "lock-up" and no puck is released. If a puck different from puck H is placed upon the holder, the dielectric value of the capacitor will still change, but the new capacitor value will not correspond to that for which the apparatus is calibrated, and a puck will still not be thrown. Different objects thrown by the apparatus can be made so that the resulting capacitance value varies from one object to the next, and the apparatus is calibrated so that it will throw only one type of object. Thus, use of a hockey puck H for ice hockey will result in a different capacitor value than a puck used in street hockey, so an apparatus used for street hockey will not throw ice hockey pucks.

Figure 13:
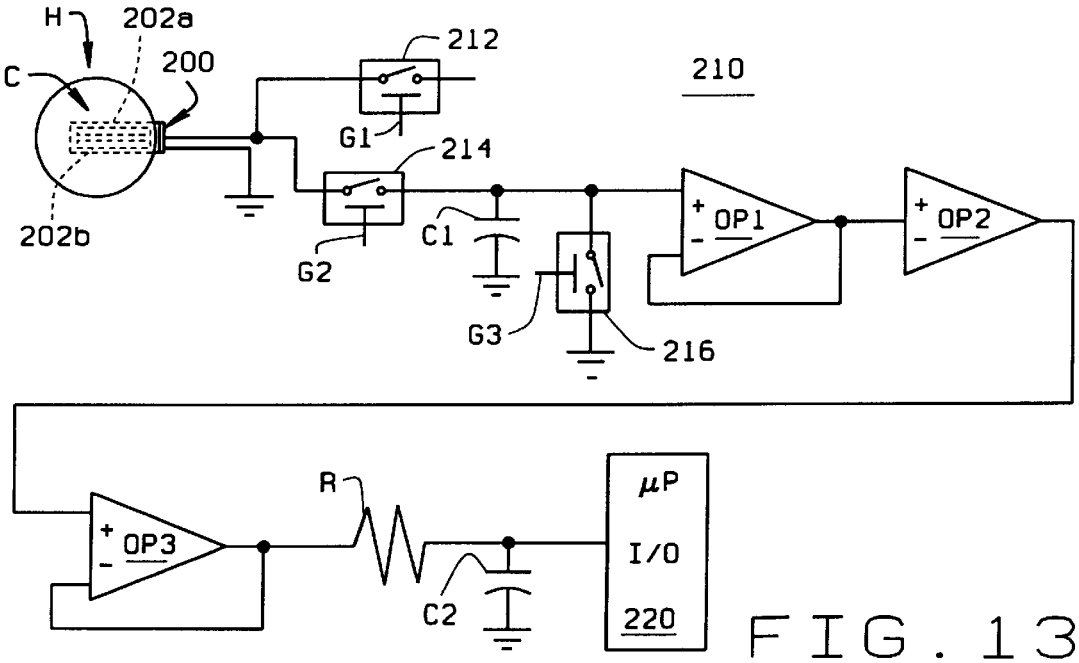

In FIG. 13, circuit 210 includes a capacitance sensor for sensing a change in capacitance of capacitor C when puck H is placed on holder 200. In circuit 200, metal strip 202*b* of capacitor C is grounded. MOSFET analog switches 212, 214 have respective gates 61, 62 connected to a microprocessor 220 of the control means. When gate 61 is switched to a logic "1" switch 212 switches to a low impedance state which connects metal strip 202*a* to +5 VDC, for example. This charges capacitor C. Gate 61 is then switched to logic "O", returning switch 212 to its high impedance state. Switch 214 is then switched "on" (gate 62 now being switched to a logic "1") to allow the charge built up on capacitor C to flow to a capacitor C1. A voltage is now developed across the capacitor which is directly proportional to the amount of charge transferred between capacitors C and C1.

After the charge transfer between the capacitors, another analog switch 216 is operated by the microprocessor so a gate 63 of the switch switches to a logic "1" state. This places the charge of capacitor C1 on the non-inverting input of an operational amplifier (op-amp) OP1 having unity gain. The output of op-amp OP1 is provided to one or more stages of amplification represented by an op-amp OP2. The amplified capacitance value is processed through another unity gain op-amp OP3 to an input of microprocessor 220. Op-amp OP3 provides a low impedance drive. The output signal of op-amp OP3 charges a capacitor C2 through a resistor R. An input/output (I/O) terminal of the microprocessor. Normally, this terminal of the microprocessor is held at a logic "O", which holds the capacitor C2 at near OV. When the terminal is switched to a logic "1", so a digital input can be applied to the terminal, capacitor C2 is now allowed to charge to a value which is a function of the voltage output from op-amp OP3. This voltage is representative of the capacitance of capacitor C. If the voltage across capacitor C2 now exceeds a predetermined threshold value, it is indicative that a puck H is positioned on holder 200, and the apparatus is operated, as previously described, to throw the puck. Otherwise, the apparatus is inhibited from throwing the puck.

It will be understood by those skilled in the art that other physical characteristics of the puck, or indicia formed on, or added to, the puck can also be used for safety purposes. In addition to the dielectric characteristics discussed above, the effect of the puck in an inductance or resistance sensitive circuit can also be used. So too, can the weight of the puck, its ability to pass through or reflect radio frequency signals, its radioactive properties, if any, and its light absorption or light reflective properties.

With respect to the weight, of certain objects such as clay pigeons, balls, and pucks, in addition to weight being used to determine whether or not an object is to be thrown, minor changes in weight result in the object being released on a different trajectory than an object with a slightly different weight. This introduces a desirable element of variability in the apparatus because the person using the apparatus must react to the difference and they cannot expect to see the same thing every time an object is released.

Besides these properties, other features which may be utilized include forming the object of a particular color or placing a color marker such as a color strip on the object and using an imaging system to recognize the color of the strip. On baseball or tennis ball covers, an infrared marker can be used which is recognizable by the imaging system. On some objects such as clay pigeons or pucks, a cavity or indentation can be made when the object is made and the apparatus will employ feelers which sense these to validate the object as one to be thrown. Alternatively, small bumps or projections can be formed on a surface of the clay pigeon or puck with the feeler system sensing their presence as they feed onto the throwing arm. However implemented, control means 112, in addition to locking out the apparatus from throwing the object provides a visual or audible indication alerting the user that an inappropriate object has been set into the apparatus for throwing.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for throwing an object relative to a person interacting with the object comprising:

holding means for releasably holding the object;

means for moving the holding means with the holding means releasing the object during its movement;

a first sensing means for sensing the location of the person who responds to release of the object to perform an activity involving the object;

control means responsive to the sensing means and to the object to effect release of the object for the object to be released in a desired direction relative to the person, said control means being responsive to said first sensing means to locate both the person interacting with the object when it is released, and any other person in the vicinity of said apparatus, said control means effecting release of said object only if said person interacting is in a location to interact with said object and no other person is in a path which the object will traverse when it is released; and, a second sensing means responsive to said object to provide a signal to said control means that said object is a proper object to release, said control means not releasing said object unless it receives an indication from said second sensing means that said object is acceptable to release, said holding means including a capacitor whose capacitance is effected by the object placed on the holding means, and said control means including a circuit responsive to the capacitance value when the object is placed on a throwing arm to provide an indication to said control means as to whether or not said object can be released.

2. The apparatus of claim 1 further including means for remotely activating the apparatus to release an object.

3. The apparatus of claim 2 wherein said means for remotely activating an object includes a voice means.

4. The apparatus of claim 1 wherein said control means is responsive to an indication from said sensing means as to the location of said person to operate said release means and release said throwing arm to release said object.

5. The apparatus of claim 4 wherein said control means is further responsive to an indication from said sensing means that said person is not where the person should be to inhibit said release means whereby the throwing arm is not released and no object is released.

6. The apparatus of claim 5 wherein said control means is further responsive to an indication from said sensing means that another person is present, in addition to said person interacting with said object, to inhibit said release means so the throwing arm is not released and no object is released, if said other person is in a line of flight of said object and could possibly be struck by said object.

7. The apparatus of claim 1 further including a movable platform on which said apparatus is installed, said control means moving said platform to change the direction in which said object is released relative to said person.

8. The apparatus of claim 7 wherein the objects which can be released by said apparatus include spherical or disc shaped objects.

9. Apparatus for throwing a hockey puck toward a person interacting with the puck comprising:

an arm releasably holding said puck;

means for moving said arm for the arm to release said puck during movement of the arm;

a first sensor for sensing the location of said person and a second sensor for sensing if the hockey puck is acceptable to release; and, control means responsive to said first sensor to control release of said puck for said puck to be released in a desired direction relative to said person; and, a movable platform on which said apparatus is installed, said control means moving said platform to change the direction in which said puck is released relative to said person.

10. The apparatus of claim 9 further including voice activated means for remotely activating the apparatus to release said puck.

11. The apparatus of claim 9 wherein said control means is responsive to an indication from said first sensor as to the location of said person to operate said release means and release said arm to release said puck.

12. The apparatus of claim 11 wherein said control means is further responsive to an indication from said first sensor that said person is not where the person should be to inhibit said release means whereby said arm is not released and no puck is released.

13. The apparatus of claim 12 wherein said control means is further responsive to an indication from said first sensor that another person is present, in addition to said person interacting with said puck, to inhibit said release means so said arm is not released and no puck is released, if said another person is in a line of flight of said object and could possibly be struck by said puck.

14. The apparatus of claim 13 wherein said first sensor comprises a passive infrared sensor.

15. The apparatus of claim 9 wherein said second sensor is responsive to a characteristic of said puck to provide a signal to said control means that said puck is acceptable to release, said control means not releasing said puck unless it receives an acceptable indication from said second sensor.

16. The apparatus of claim 15 wherein said arm includes a holder for said puck and said second sensor includes a capacitor on said holder whose capacitance is a function of the puck placed in the holder, and said control means includes a sensing circuit responsive to the capacitance value when a puck is placed on said holder to provide an indication to said control means as to whether or not said puck is to be released.

17. Apparatus for throwing an object relative to a person interacting with the object comprising:

a rotatable arm releasably holding the object;

a motor;

gear means including a worm and worm gear combination interconnected with said motor and said arm for said motor to rotate said arm in a desired direction through said gear means;

a spring interconnected with said arm and movable by rotation of said arm to stretch said spring; and, release means for allowing said spring to rapidly return from a stretched position to a relaxed position during which movement energy stored in said spring is transferred to said arm to rotate said arm at a speed sufficient to release said object on a desired path relative to said person, said release means including a pin driven by said gear means and engaging said arm to force said arm to rotate in a predetermined direction during which said spring is stretched, said spring reaching an over-center position when said pin is driven by said gear means to rotate said arm a predetermined amount by said pin at which time said spring rapidly returns to its relaxed position and rotates said arm to release said object; and, a pawl and ratchet combination which allows said pin to move said arm in one-way.

18. Apparatus for throwing a hockey puck toward a person interacting with the puck comprising:

an arm releasably holding said puck;

means for moving the arm, the puck being released during movement of the arm;

sensor means for sensing the location of said person and that a hockey puck is in position to be released;

control means responsive to said sensor means to control release of said puck in a desired direction relative to said person; and, a movable platform on which said apparatus is installed, said control means moving said platform to change the direction in which said puck is released relative to said person.

* * * * *